US007549242B2

(12) United States Patent
Schmeling et al.

(10) Patent No.: US 7,549,242 B2
(45) Date of Patent: Jun. 23, 2009

(54) MULTIPLE BOOM FOR EXCAVATORS

(75) Inventors: Ralf Schmeling, Berlin (DE); Bernhard Willaredt, Berlin (DE); Holger Oertel, Berlin (DE); Birgit Ditz, Potsdam (DE)

(73) Assignee: CNH Baumaschinen GmbH, Berlin (DE)

( * ) Notice: Subject to any disclaimer, the term of this patent is extended or adjusted under 35 U.S.C. 154(b) by 107 days.

(21) Appl. No.: 10/556,197

(22) PCT Filed: Apr. 24, 2004

(86) PCT No.: PCT/DE2004/000862

§ 371 (c)(1),
(2), (4) Date: Aug. 4, 2006

(87) PCT Pub. No.: WO2004/101901

PCT Pub. Date: Nov. 25, 2004

(65) Prior Publication Data

US 2007/0157491 A1 Jul. 12, 2007

(30) Foreign Application Priority Data

May 10, 2003 (DE) ..... 103 21 070

(51) Int. Cl.
*E02F 3/32* (2006.01)

(52) U.S. Cl. ..... 37/443; 37/379; 414/694; 414/685

(58) Field of Classification Search ..... 37/443, 37/395, 397; 414/694
See application file for complete search history.

(56) References Cited

U.S. PATENT DOCUMENTS

| | | | | | |
|---|---|---|---|---|---|
| 4,077,140 | A * | 3/1978 | Branconi | 37/443 |
| 4,444,542 | A * | 4/1984 | Shaw et al. | 414/694 |
| 5,054,990 | A * | 10/1991 | Schaeff | 414/694 |
| 5,266,001 | A * | 11/1993 | Kanayama et al. | 414/694 |
| 5,584,643 | A * | 12/1996 | Nishimura et al. | 414/694 |
| 5,606,809 | A * | 3/1997 | Allen | 37/443 |
| 5,661,917 | A * | 9/1997 | Marchetta et al. | 37/348 |
| 5,822,892 | A * | 10/1998 | Ohbatake et al. | 37/397 |
| 6,101,437 | A * | 8/2000 | Oshina et al. | 701/50 |
| 6,920,708 | B2 * | 7/2005 | Bates | 37/443 |

FOREIGN PATENT DOCUMENTS

| | | |
|---|---|---|
| DE | 85 12 238 U | 8/1985 |
| EP | 0 448 849 A | 10/1991 |
| EP | 0 701 027 A | 3/1996 |
| EP | 0 791 693 A1 | 8/1997 |

* cited by examiner

*Primary Examiner*—Thomas A Beach
*Assistant Examiner*—Matthew R Buck
(74) *Attorney, Agent, or Firm*—Patrick M. Sheldrake; John William Stader; Michael G. Harms

(57) ABSTRACT

The invention is directed to an articulated joint between the back boom and the main boom of a multiple boom for an excavator so that it: permits a sufficiently wide angle of movement between both parts of the boom, permits maximum boom reach, and is in a position to accept high forces, all while also providing a cost-saving design.

6 Claims, 2 Drawing Sheets

MULTIPLE BOOM FOR EXCAVATORS

FIELD OF THE INVENTION

The present invention concerns a multiple boom for excavators for the removal and lifting of material as well as all other work which may be accomplished by such an excavator.

BACKGROUND OF THE INVENTION

A variety of alternative embodiments of multiple booms are already known. One of the most widespread solutions is used on several models of the applicant's own excavators. In this case, the lower end of the back boom is attached to a drag link on the frame of the revolving superstructure. The upper end of the upward-pointing back boom takes the form of an upward-opening fork, in which the rear area of the main boom is accepted by an articulated joint at a certain distance in front of its rear end, seen in the direction of movement of the excavator.

To facilitate the swivel movement of the back boom, a hydraulic boom cylinder is provided, one end of which acts on the articulated joint between the back boom and the main boom and the other end on a knuckle on the frame at a certain distance from the drag link of the back boom.

A hydraulic adjustment cylinder, lying to the rear and thus pulling under load, acts on an articulation pin located on the rear of the main boom to raise and lower it, the lower end of said cylinder being mounted on a bracket on a fixed pivot in the lower area of the back boom.

The front end of the main boom, seen in the direction of movement of the excavator, also takes the form of an open fork, to which the rear part of the stick boom is articulated at a certain distance from its rear end. Swivel movement of the stick boom is carried out by a hydraulic stick boom cylinder mounted above the main boom, the rear end of which is articulated to the main boom and the front end of which acts on the rear end of the stick boom.

A tool, usually a backhoe, is mounted on the front end of the stick boom. The tool is swiveled by a backhoe cylinder mounted above it on the stick boom, the rear end of which, analogous to the description above, is articulated to the stick boom and the front end of which is attached to the tool, either directly, or by a connecting rod and/or oscillating crank.

This solution has certain disadvantages, namely that the articulated joint between the back boom and the main boom must be located as high as possible in order to achieve maximum boom reach, so that the boom cylinder is required to be as long as possible. However, road traffic regulations place a limit on its length, because the height of vehicles on the public highway must not exceed 4 meters. This articulated joint is therefore located just below the upper edge of the main boom. However, this means that the upward-opening fork of the back boom must have relatively long sides in order to accept the entire cross-section, said sides having to be very strong, and thus cost-intensive, due to the high forces acting at this point. In addition, this fork must have an apex angle of around 180° to ensure that the main boom can move through an angle of around 90° in relation to the back boom, thereby placing a further restriction on the strength of the fork. For these reasons, there are limits on the ability of the fork to accept higher forces, despite a very strong embodiment.

SUMMARY OF THE INVENTION

The invention is therefore based upon the problem of designing the articulated joint between the back boom and the main boom of a multiple boom for an excavator so that it: permits a sufficiently wide angle of movement between both parts of the boom, permits maximum boom reach, and is in a position to accept high forces, all while also providing a cost-saving design.

The problem is solved inventively by the characteristics of the invention described in the claims.

By inserting the upper end of the back boom into the main boom, the former need no longer have gaps or recesses as in the state of the art, making it highly kink-resistant. Manufacture of the back boom as a closed box section presents one possibility of so doing.

This design is very strong overall, as the section of the main boom placed over the back boom must then be larger than that of the back boom anyway and its weakening in the vicinity of the accepted back boom is slight, because only the actual angle of movement needs to be unobstructed as a fork in this embodiment. It also permits location of the articulated joint between the back boom and the main boom immediately below the upper edge of the main boom.

In conclusion, the advantages of the invention are that very high forces can be transmitted by such an articulated joint. Its construction is simple and it can therefore be manufactured cost-effectively. Its location at the highest point on the excavator in the transport position gives the boom maximum reach. The invention will now be explained in more detail by means of a specimen embodiment, whereby:

DETAILED DESCRIPTION OF THE EXEMPLARY EMBODIMENTS

Figure 1:
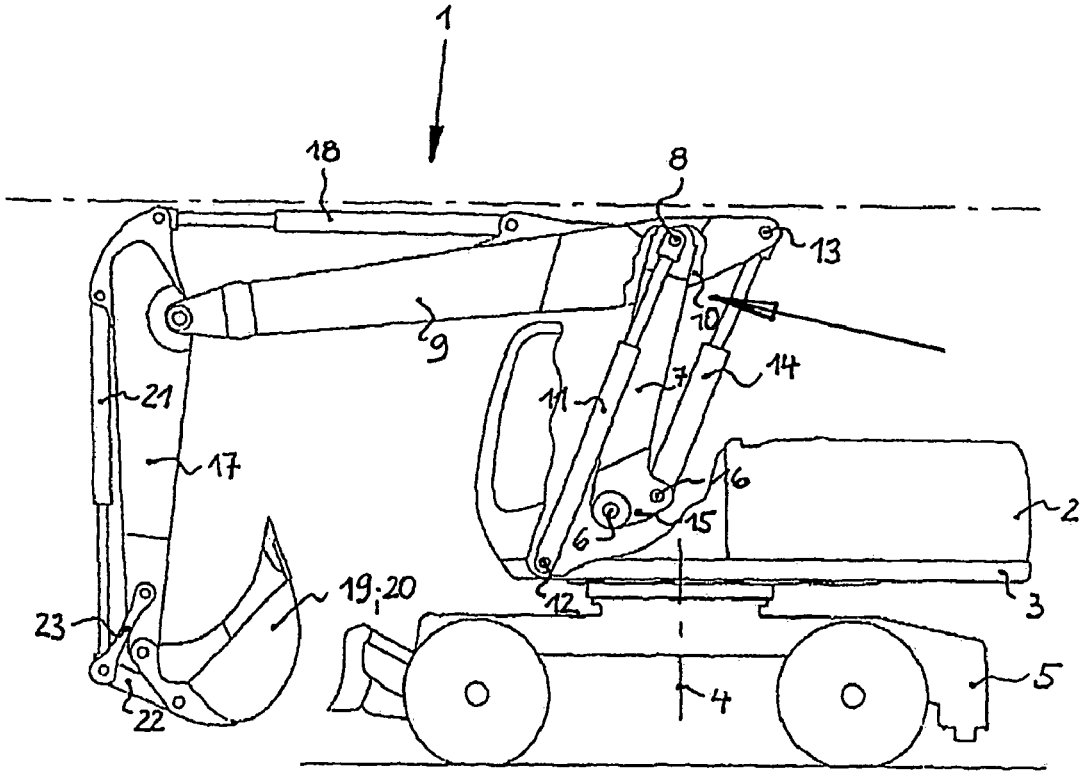
FIG. 1 is an elevation of the left-hand side of an excavator with a multiple boom.
Figure 2:
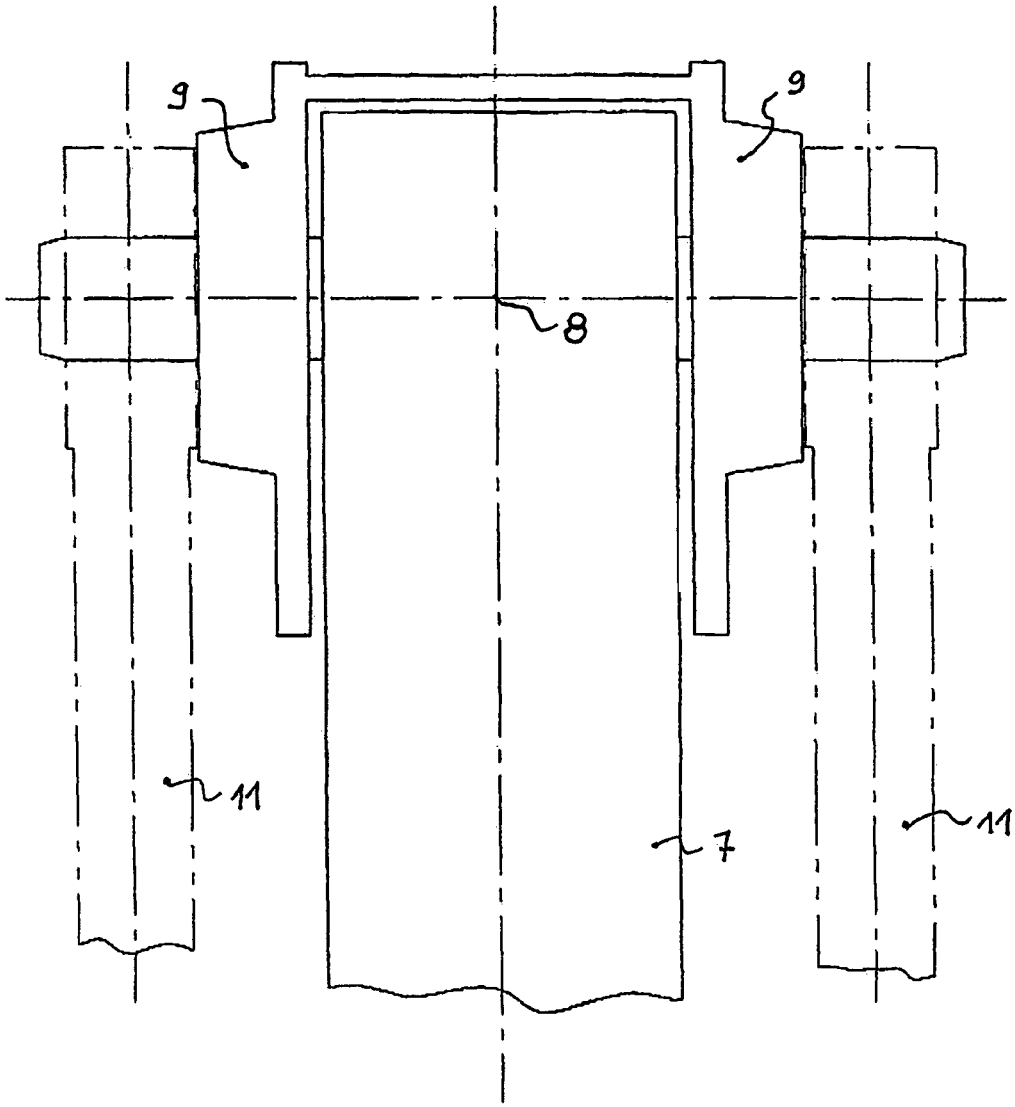
FIG. 2 is a view of the articulated joint for connecting the back boom to the main boom.

The side elevation in FIG. 1 shows the structure of the multiple boom 1, which is mounted on the revolving superstructure 2 of the excavator and is attached to its frame 3. The revolving superstructure 2 can be swiveled in relation to the chassis 5 in a horizontal plane about a vertically-aligned axis 4. It consists firstly of a back boom 7, the lower end of which is attached to a drag link 6 on the frame 3. Its upper end is connected to the abutting main boom 9 by means of an articulated joint 8, said articulated joint 8 being located inside the main boom 9 immediately below its upper edge and at a certain distance from its rear end. An enlarged diagrammatic view of this connection is shown in FIG. 2.

The back boom 7, including its upper end, takes the form of a kink-resistant, closed section, and is inserted in the main boom 9 from below. The main boom 9 has a downward-opening fork 10 accepting the back boom 7 at least in the vicinity of the articulated joint 8.

A hydraulic boom cylinder 11 is provided to swivel the back boom 7, one end of said hydraulic boom cylinder 11 acting on the articulated joint 8 and its other end being mounted on a knuckle 12, which is located on the frame 3 at a certain distance from the drag link 6 of the back boom 7.

A hydraulic adjustment cylinder 14, lying to the rear and thus pulling under load, acts on an articulation pin 13 located on the rear of the main boom 9 to raise and lower it, the lower end of said hydraulic adjustment cylinder 14 being mounted on a bracket 15 on a fixed pivot 16 in the lower area of the back boom 7.

In the interests of a complete description of the multiple boom 1, it is stated that the front end of the main boom 9, seen in the direction of movement of the excavator, also takes the form of an open fork, to which the rear part of the stick 17 is articulated at a certain distance from its rear end. The stick boom 17 is swiveled by a hydraulic stick cylinder 18 mounted above the main boom 9, to which the rear end of the hydraulic stick cylinder 18 is articulated, its front end acting on the rear end of the stick boom 17. A tool 19, usually a backhoe 20, is mounted on the front end of the stick boom 17. The tool is swiveled by a backhoe cylinder 21 mounted above it on the stick boom 17, the rear end of which backhoe cylinder 21, analogously to the aforegoing, is articulated to the stick boom 17 and the front end of which is attached to the tool 19, either directly or through a connecting rod 22 and/or oscillating crank 23.

The invention claimed is:

1. A multiple boom for excavators having a frame and a revolving superstructure, the multiple boom comprising:

a main boom having a front end and a rear end:

a back boom having a lower end and an upper end, the lower end attached to a drag link mounted on the frame of the revolving superstructure; the upper end of the back boom is inserted into the main boom from below, the main boom designed as a downward-opening fork accepting the upper end of the back boom;

an articulated joint located close to an upper edge of the main boom, connecting the upper end of the back boom directly with the downward opening fork of the main boom at a distance from the rear end of the main boom, such that a portion of the back boom is located within the main boom;

a boom cylinder having a first end directly connected to the articulated joint and a second end acting on a knuckle on the frame; and an adjustment cylinder located between an articulation pin mounted at the rear end of the main boom and a fixed pivot located near the lower end of the back boom.

2. The multiple boom for excavators as described in claim 1, wherein the upper end of the back boom is designed to be a kink resistant closed section.

3. The multiple boom for excavators as described in claim 1, further comprising:

a hydraulic boom cylinder provided to swivel the back boom, the hydraulic boom cylinder having first and second ends, the first end of the hydraulic boom cylinder acting on the articulated joint and the second end mounted on the knuckle.

4. The multiple boom for excavators as described in claim 1, wherein the articulated joint is located above the midpoint of an imaginary line extending perpendicularly from the upper edge of the main boom to a lower edge of the main boom and passing through the midpoint of the articulated joint.

5. The multiple boom for excavators as described in claim 1, wherein the articulated joint is located above an imaginary line extending between the articulation pin and the back boom and a pivot connecting the main boom to an additional boom.

6. The multiple boom for excavators as described in claim 1, the articulated joint has a pin extending through the main boom and a portion of the back boom located within the main boom to which the boom cylinder is connected.

* * * * *